US006309291B1

(12) United States Patent
Cox

(10) Patent No.: US 6,309,291 B1
(45) Date of Patent: Oct. 30, 2001

(54) BRUSH CUTTER

(76) Inventor: Bill Robertson Cox, 478 Cloverhill Ct., Dayton, OH (US) 45440

( * ) Notice: Subject to any disclaimer, the term of this patent is extended or adjusted under 35 U.S.C. 154(b) by 0 days.

(21) Appl. No.: 09/418,075

(22) Filed: Oct. 14, 1999

(51) Int. Cl.[7] ..... B24B 9/04

(52) U.S. Cl. ..... 451/464; 451/469; 451/490; 15/179; 15/180; 15/200

(58) Field of Search ..... 18/230.16, 230, 18/200; 15/183, 202, 179, 180, 194, 198, 200; 451/466, 468, 469, 490; 407/40

(56) References Cited

U.S. PATENT DOCUMENTS

| | | | | |
|---|---|---|---|---|
| 1,082,922 | | 12/1913 | Bemis . | |
| 1,100,113 | | 6/1914 | Bemis . | |
| 1,998,562 | * | 4/1935 | Sturgis | 15/180 |
| 2,311,135 | | 2/1943 | Steinmetz et al. . | |
| 2,648,893 | * | 8/1953 | Begle et al. | 407/40 |
| 2,950,524 | * | 8/1960 | Frommelt et al. | 407/40 |
| 3,163,920 | * | 1/1965 | Stier | 407/40 |
| 4,077,081 | | 3/1978 | Drumm . | |
| 4,302,863 | | 12/1981 | Droeser . | |
| 4,534,080 | | 8/1985 | Young et al. . | |
| 5,446,939 | * | 9/1995 | Park | 15/179 |
| 5,755,003 | * | 5/1998 | Altermare et al. | 15/180 |
| 5,766,060 | * | 6/1998 | Foreman et al. | 451/63 |

* cited by examiner

*Primary Examiner*—Joseph J. Hail, III
*Assistant Examiner*—George Nguyen
(74) *Attorney, Agent, or Firm*—Biebel & French

(57) ABSTRACT

A brush cutter adapted to be driven in rotary motion by a conventional machine tool. The brush cutter includes an annular wall having a cylindrical outer surface defining a longitudinal center axis. Front and rear faces are connected to opposing ends of the cylindrical outer surface. An arbor bore and a counterbore are concentrically disposed and coaxially aligned with the center axis. A plurality of brush assemblies are received within a plurality of circumferentially spaced axial and radial receiving bores. The axial receiving bores extend axially inwardly from the front face and the radial receiving bores extend radially inwardly from the cylindrical outer surface.

20 Claims, 5 Drawing Sheets

BRUSH CUTTER

BACKGROUND OF THE INVENTION

1. Field of the Invention

The present invention relates to cutters and, more particularly, to a brush cutter adapted to be driven in rotation by a conventional machine tool, such as a milling machine for removing material from a workpiece.

2. Description of the Prior Art

Workpieces manufactured from conventional casting and subsequent milling operations often contain numerous burrs which must be removed in order to provide an end product of acceptable quality. Burrs are generally small, sometimes flexible projections adhering strongly to the edge of a workpiece. If burrs are not removed, they can cause assembly failures, short circuits, injuries to workers, and even fatigue failures.

Traditional deburring operations have often consisted of an individual manually removing burrs from the workpiece using a knife-like deburring tool. As may be appreciated, this is a very labor intensive and time consuming process which often results in a low workpiece production rate.

In order to improve the efficiency of deburring workpieces, grinding wheels, carbide tips or brush cutters driven in rotation by a conventional hand held power tool are sometimes utilized. Conventional brush cutters include a plurality of closely spaced metal wire bristles which are moved over the workpiece surface while rotating, thereby cutting burrs from such surface. Unfortunately, these brush cutters often clog or "gum up" by removed burrs or chips which are entrapped between the rotating bristles during the cutting operation. This shortcoming is often exacerbated with increased cutting speeds wherein conventional brush cutters are typically limited to a maximum operating speed of approximately 200 surface feet per minute. The removed burrs or chips between the bristles typically melt together at higher operating speeds.

Additionally, conventional brush cutters have a limited surface area for contacting the workpiece to be deburred. Once again, due to the compact wire bristle arrangement, the overall operating diameter of the brush cutter is necessarily limited. As is readily apparent, with a small operating diameter brush cutter, more time is required to debur any given workpiece.

Accordingly, there remains a need for a brush cutter which may be powered by a conventional machine tool while operating at increased speeds for producing high quality deburred workpieces.

SUMMARY OF THE INVENTION

The present invention provides a brush cutter which may be operably connected to a conventional machine tool for quickly and efficiently deburring workpieces while providing an improved surface finish on the workpiece.

The brush cutter of the present invention is adapted for being driven in rotation by a spindle of a conventional machine tool, such as a horizontal or vertical milling machine. The machine tool includes a spindle supporting a shell mill arbor for rotation. The arbor includes a cylindrical body portion supporting a pair of diametrically opposed keys and a cylindrical pilot positioned intermediate the keys. The pilot includes an internally threaded aperture coaxially aligned along the longitudinal center axis of the arbor.

The brush cutter comprises a housing including an annular wall having a cylindrical outer surface defining a longitudinal center axis coaxial with the center axis of the arbor. Front and rear faces are connected to, and positioned in space relation to each other by, the annular wall. A cylindrical inner surface defines an arbor bore extending axially inwardly from the rear face towards the front face and coaxially aligned with the center axis. The arbor bore slidably receives the pilot of the arbor.

A cylindrical intermediate surface is positioned intermediate the outer surface and the inner surface and defines a counterbore extending from the front face towards the rear face which is coaxially aligned with the center axis. The counterbore is concentrically positioned relative to the arbor bore and is in communication with the arbor bore. A lock shoulder is defined between the arbor bore and the counterbore.

A plurality of circumferentially spaced axial receiving bores extend within the body axially inwardly from the front face towards the rear face. Similarly, a plurality of circumferentially spaced radial receiving bores extend within the body substantially radially inwardly from the outer surface.

An arbor lock screw includes a threaded shaft which is threadably received within the threaded aperture of the pilot. The lock screw further includes an enlarged head integral with the shaft, wherein the head is received within the counterbore of the body and engages the lock shoulder for securing the housing to the arbor. A pair of diametrically opposed keyways extend inwardly from the rear face of the brush cutter and are adapted to receive the pair of keys of the arbor for rotatably securing the housing to the spindle.

A plurality of brush assemblies are slidably and removably received within the plurality of axial and radial receiving bores. A plurality of circumferentially spaced cutting passageways are positioned intermediate the brush assemblies for facilitating the removal of cut material away from the center axis of the housing.

Each brush assembly includes a sleeve and a plurality of metal wire bristles fixed within the sleeve. Each brush assembly further comprises a stem connected to and concentrically disposed relative to the sleeve. Each axial and radial receiving bore includes an outer portion for receiving the sleeve and an inner portion in communication with the outer portion for receiving the stem. A plurality of first and second set screws extend within the housing wherein each first set screw engages a sleeve and each second set screw engages a stem of a respective brush assembly.

Therefore, it is an object of the present invention to provide a brush cutter which may be operably connected to a conventional machine tool.

It is another object of the present invention to provide such a brush cutter having a structure which facilitates easy installation and removal from a conventional machine tool.

It is a further object of the present invention to provide such a brush cutter which may be operated at increased surface speeds thereby improving production efficiency.

It is another object of the present invention to provide such a brush cutter which effectively removes cuttings from the brush assemblies thereby preventing clogging or gumming up of the wire bristles.

It is a further object of the present invention to provide a brush cutter including a plurality of easily replaceable brush assemblies.

It is yet another object of the present invention to provide a brush cutter including a plurality of axially and radially disposed brush assemblies thereby providing improved versatility in deburring workpieces.

It is a further object of the present invention to provide a brush cutter which produces an improved surface finish on the workpiece.

Other objects and advantages of the invention will be apparent from the following description, the accompanying drawings and the appended claims.

DETAILED DESCRIPTION OF THE PREFERRED EMBODIMENT

Figure 1:
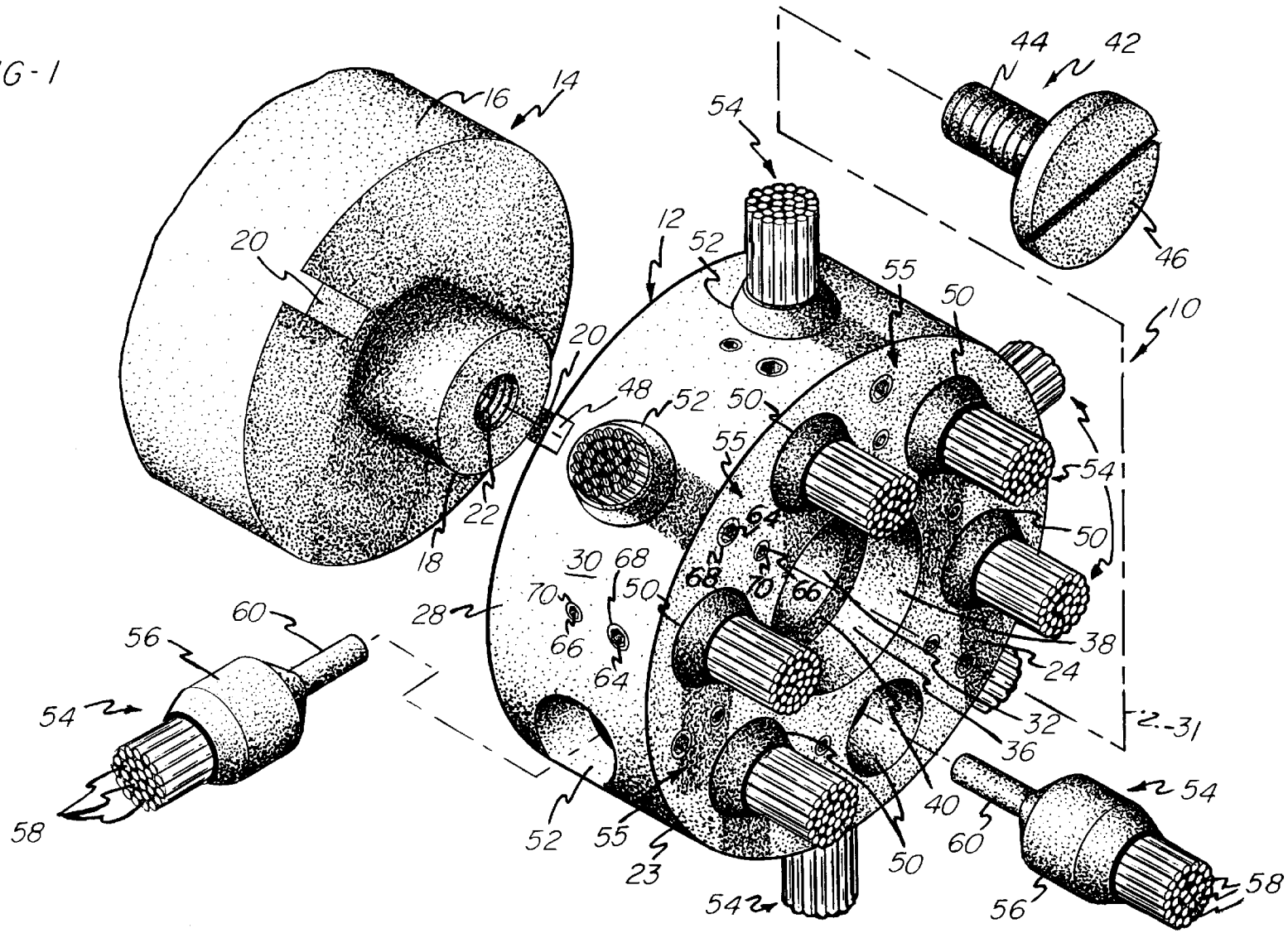
FIG. 1 is a partially exploded front perspective view of the brush cutter of the present invention.
Figure 2:
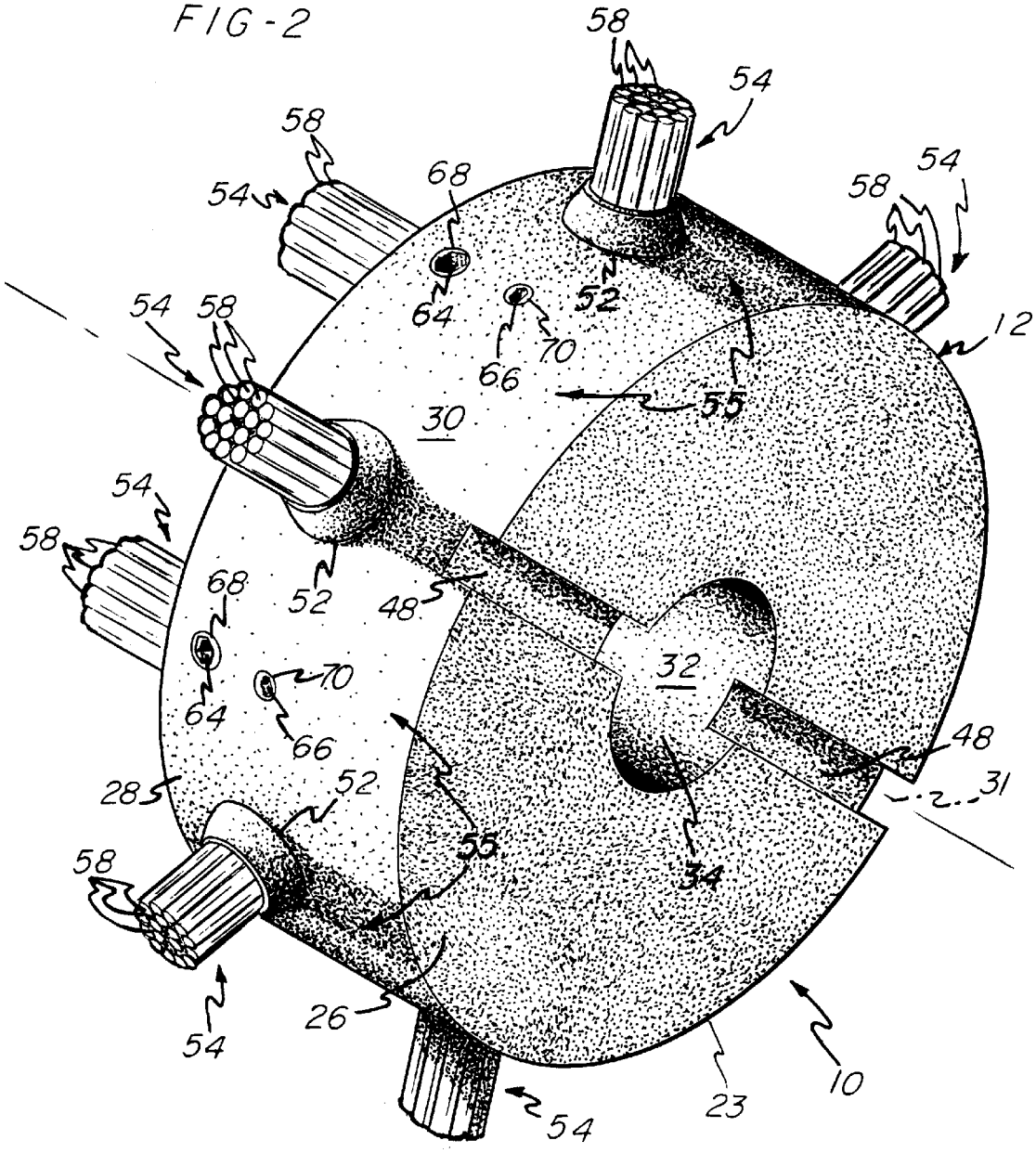
FIG. 2 is a rear perspective view of the brush cutter of the present invention.

Referring initially to FIGS. 1 and 2, the brush cutter 10 of the present invention is illustrated as including a housing 12 preferably machined from hardened steel. The housing 12 is adapted to be supported for rotation by a conventional shell mill arbor 14 which, in turn, is supported by the spindle of a conventional machine tool, preferably a vertical or horizontal milling machine (not shown). The arbor 14 includes a cylindrical body portion 16 including a concentrically disposed cylindrical pilot 18. A pair of diametrically opposed keys 20 is disposed on opposite sides of the pilot 18. An internally threaded aperture 22 is concentrically formed within the pilot 18. While the shell mill arbor 14 preferably comprises Part No. C-654-1500 available from Command Corporation International of Minneapolis, Minn., any similar arbor may be readily substituted therefor.

The housing 12 includes a body 23 having front and rear faces 24 and 26 connected to, and spaced apart by, an annular outer wall 28. The annular wall 28 includes a cylindrical outer surface 30 which defines a longitudinal center axis 31. A cylindrical inner surface 32 is concentrically disposed relative to the outer surface 30 and is coaxially aligned with the center axis 31. The inner surface 32 defines an arbor bore 34 extending within the body 23 from the rear face 26 towards the front face 24.

A cylindrical intermediate surface 36 is positioned intermediate the outer and inner surfaces 30 and 32. More particularly, the cylindrical intermediate surface 36 has a diameter between that of the outer surface 30 and inner surface 32. The intermediate surface 36 defines a counterbore 38 which is concentrically disposed relative to the arbor bore 34 and coaxially aligned with the center axis 31. The arbor bore 34 and counterbore 38 are in communication with each other and define a lock shoulder 40 therebetween.

An arbor lock screw 42 includes a threaded shaft 44 which is threadably received within the threaded aperture 22 of the pilot 18. The arbor lock screw 42 further includes an enlarged head 46 which is received within the counterbore 38 and engages the lock shoulder 40 for securing the housing 12 to the arbor 14, and subsequently to the spindle of the milling machine. While FIG. 1 illustrates a conventional arbor lock screw 42 including a slotted enlarged head 46, it should be appreciated that similar fasteners, including screws with allen-heads, may be readily substituted therefor.

A rotation registration device, preferably a pair of diametrically opposed keyways 48, extends inwardly from the rear face 26 of the body 23. The keyways 48 slidably receive the pair of keys 20 of the arbor 14. As may be readily appreciated, engagement between the keys 20 and keyways 48 prevents relative rotation between the arbor 14 and brush cutter 10.

Figure 3:
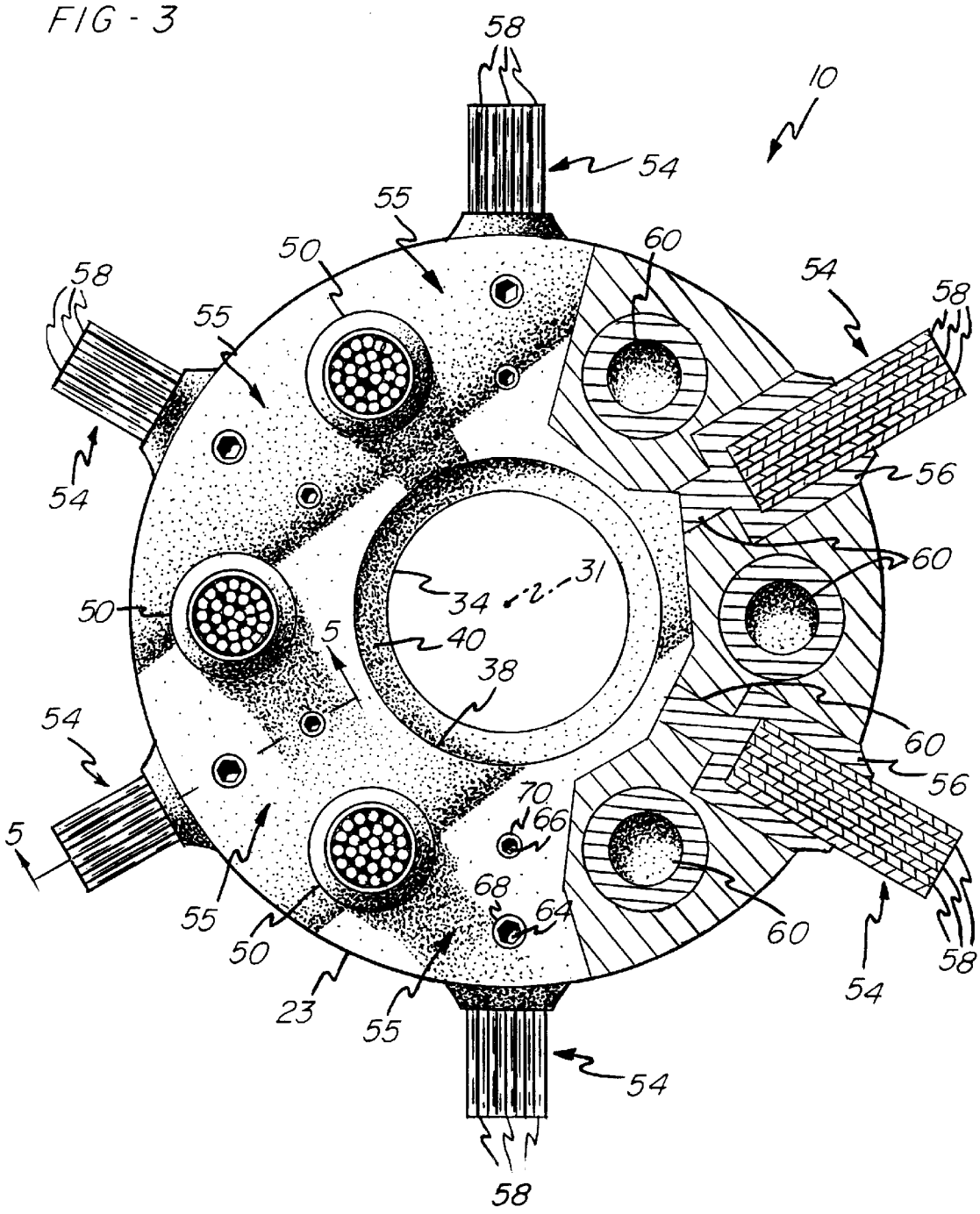
FIG. 3 is a top plan view of the brush cutter of the present invention; with a partial cut away taken along line 3—3 in FIG. 4.
Figure 4:
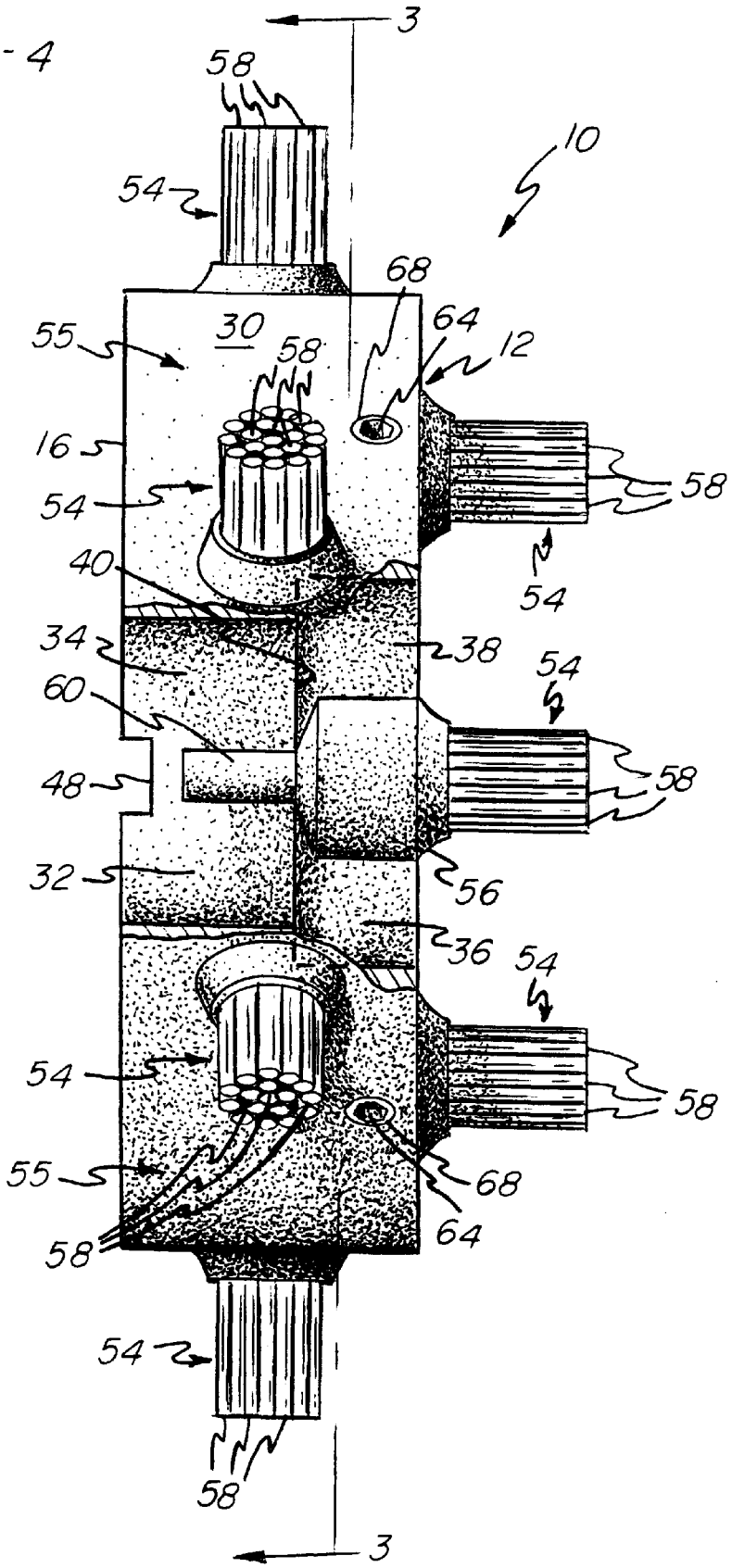
FIG. 4 is a side elevational view, with a partial cut away, of the brush cutter of the present invention.

A plurality of circumferentially equally spaced axial receiving bores 50 extend inwardly from the front face 24 of the body 23 in a direction substantially parallel to the center axis 31. A plurality of circumferentially equally spaced radial receiving bores 52 extend substantially radially inwardly from the outer surface 28 in a direction substantially perpendicular to the center axis 30. As illustrated in FIGS. 1 and 3, the axial receiving bores 50 and radial receiving bores 52 are circumferentially offset from each other such that the axial receiving bores 50 are positioned intermediate circumferentially relative to the radial receiving bores 52.

A plurality of brush assemblies 54 are slidably and removably received within the plurality of axial and radial receiving bores 50 and 52. The circumferential spacing of the brush assemblies 54 defines cutting passageways 55 between each adjacent brush assembly 54 to facilitate the removal of burrs or cut material away from the housing 12.

With reference to FIGS. 1 and 3–5, each brush assembly 54 includes a cup-shaped sleeve 56 supporting a plurality of metal wire bristles 58, preferably formed of stainless steel. A stem 60 extends downwardly from, and in concentric relation with, the sleeve 56 of each brush assembly 54. The stem 60 preferably comprises a solid rod having a diameter less than that of the sleeve 56. The individual brush assemblies 54 are of conventional design and may comprise Craftsman Type No. 964841 available from Sears Roebuck & Co of Hoffman Estates, Ill. However, it may be appreciated that similar brush assemblies 54 may be readily substituted therefor.

The axial and radial receiving bores 50 and 52 may be angularly offset from true axial and radial positions as required for particular applications. For example, the radial receiving bores 52 may be offset by 45° from a true radial direction extending outwardly from the longitudinal center axis 31. As such, the brush assemblies 54 within these bores 52 are likewise angularly offset.

Figure 5:
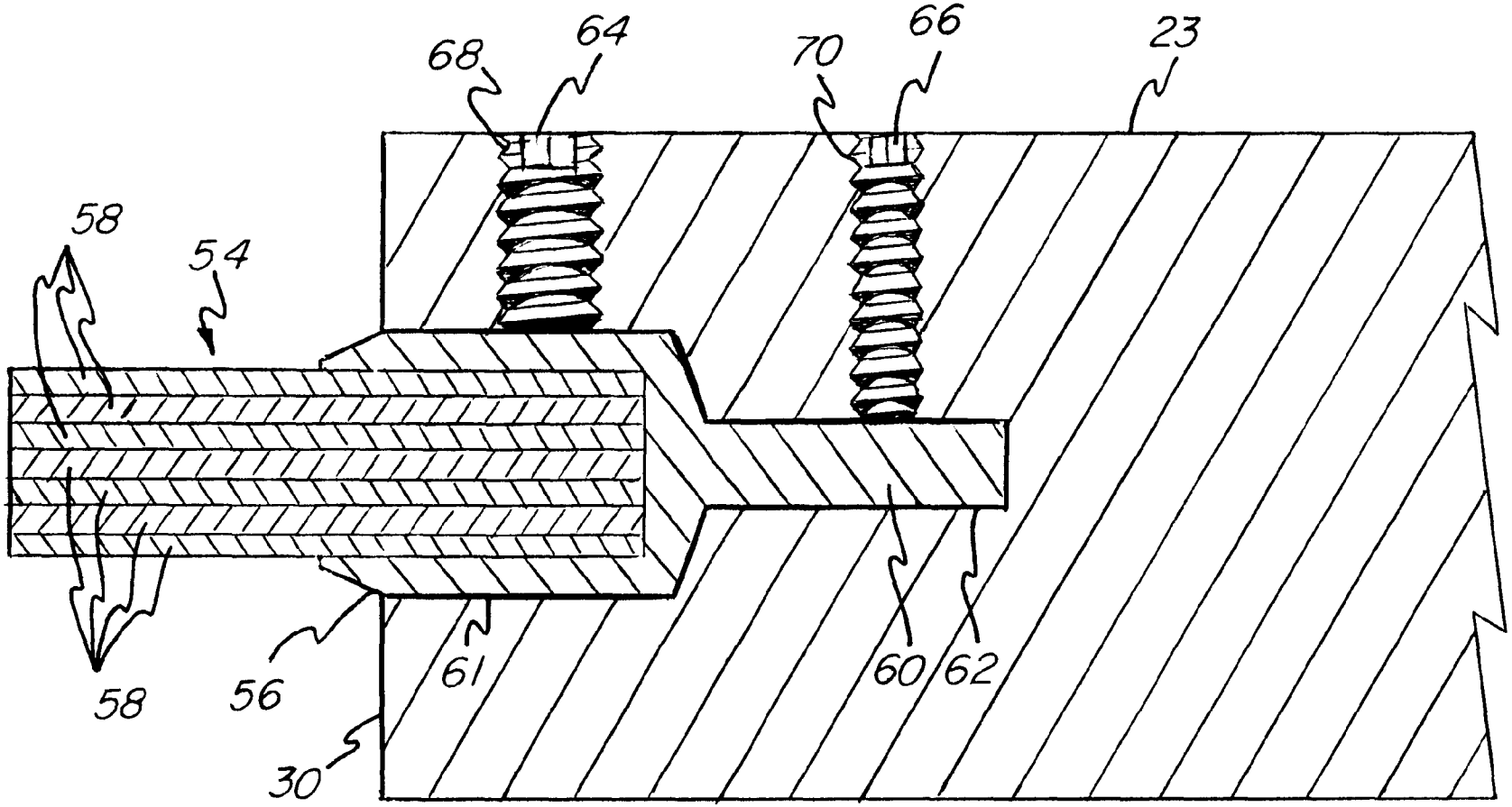
FIG. 5 is a cross-sectional view taken along line 5—5 in FIG. 3.

With further reference to FIG. 5, each of the axial and radial receiving bores 50 and 52 include an outer portion 61 positioned proximate the front face 24 or outer surface 30, respectively, of the body 23. An inner portion 62 is positioned inwardly from, and concentrically to, the outer portion 61. The outer portion 61 and inner portion 62 are in communication with each other wherein the outer portion 61 has a larger diameter than the inner portion 62. The outer portion 61 and inner portion 62 are dimensioned to slidably receive the sleeve 56 and stem 60 of a respective brush assembly 54.

A securing device, preferably first and second set screws 64 and 66, are operably connected to each of the brush assemblies 54 for releasably securing the brush assemblies 54 within the body 23. The first and second set screws 64 and 66 are circumferentially spaced within threaded apertures 68 and 70 formed within the annular wall 28. The first and second set screws 64 and 66 for securing the brush assemblies 54 positioned within the axial receiving bores 50 extend radially inwardly from the outer surface 30. Likewise, the first and second set screws 64 and 66 for securing the brush assemblies 54 positioned within the radial receiving bores 52 extend axially inwardly from the front face 24.

As illustrated in FIG. 5, each first set screw 64 is threadably received within one of the first apertures 68 formed within the body 23 and engages one of the sleeves 56. Likewise, each second set screw 66 is threadably received within one of the second threaded apertures 70 formed within the body 23 and engages the stem 60 of one of the brush assemblies 54.

In operation, the pilot 18 of the arbor 14 is slidably received within the arbor bore 34 of the brush cutter 10. The housing 12 is then rotatably secured to the arbor 14 by positioning the keys 20 within the keyways 48. The shaft 44 of the arbor lock screw 42 is then threaded within the aperture 22 of the pilot 18 such that the enlarged head 46 is received within the counterbore 38 and engages the lock shoulder 40.

With the brush cutter 10 thus secured to the arbor 14 of the machine tool, the housing 12 is rotated about the center axis 31. The rotating brush assemblies 54 are then brought into contact with the workpiece to be deburred such that the bristles 58 cut the burrs from the workpiece. The brush cutter 10 may be used to effectively remove burrs from both outer and inner surfaces of the workpiece. For example, the brush assemblies 54 may pass along inside surfaces of bores within the workpiece, thereby removing burrs therefrom. The burrs are then discharged from the housing 12 through the cutting passageways 55 by centrifugal force.

When it is desired to replace a brush assembly 54, its respective set screws 64 and 66 are loosened within apertures 68 and 70 such that the brush assembly 54 slides outwardly from its respective receiving bore 50, 52. The replacement brush assembly 54 is then slidably received within the receiving bore 50, 52 and the set screws 64 and 66 tightened wherein they engage the sleeve 56 and stem 60 thereby securing the brush assembly 54 within the body 23.

As detailed above, the circumferential spacing of the brush assemblies 54 of the present invention defines cutting passageways 55 between each adjacent brush assembly 54 to facilitate the removal of burrs or cut material away from the housing 12. As such, the cut material does not tend to accumulate within the respective bristles 58 of each brush assembly 54. Additionally, the plurality of brush assemblies 54 provide a greater bristle surface area for contacting and deburring a respective workpiece. Finally, the relative positioning of the plurality of brush assemblies 54 in both axial and radial directions provide greater versatility to the cutter 10 by facilitating the deburring of a wide variety of surfaces on any given workpiece.

Experiments performed with the brush cutter 10 of the present invention have demonstrated that the brush cutter 10 may be operated at speeds in excess of 2,000 surface feet per minute, over ten times the normal operating speed of conventional brush cutters. As mentioned above, conventional brush cutters fail to operate properly when their speeds exceed approximately 200 surface feet per minute. It has also been demonstrated that the brush cutter 10 of the present invention not only effectively deburs workpieces but simultaneously provides an improved surface finish thereon.

Therefore, it may be appreciated that the brush cutter 10 of the present invention provides a structure which may be easily adapted to conventional machine tools while providing for the efficient deburring of workpieces at increased speeds.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A cutter for being driven in rotation by a spindle, said cutter including:

a housing including an annular wall having a cylindrical outer surface and defining a longitudinal center axis, a front face connected to said outer surface, a rear face connected to said outer surface and positioned in spaced relation to said front face by said annular wall, a cylindrical inner surface defining an arbor bore extending axially inwardly from said rear face towards said front face and coaxially aligned along said center axis, a cylindrical intermediate surface defining a counterbore extending from said front face towards said rear face and coaxially aligned along said center axis, said counterbore in communication with said arbor bore, a lock shoulder defined between said arbor bore and said counterbore, a rotation registration device supported by said rear face, a plurality of circumferentially spaced axial receiving bores extending substantially axially inwardly from said front face towards said rear. face, and a plurality of circumferentially spaced radial receiving bores extending substantially radially inwardly within annular wall;

a plurality of brush assemblies slidably and removably received within a plurality of said receiving bores, each of said brush assemblies including a sleeve and a plurality of metal wire bristles fixed within said sleeve;

a securing device operably connected to each of said brush assemblies for releasably securing said brush assemblies within said housing; and a plurality of cutting passageways, each of said passageways positioned intermediate a pair of said brush assemblies for facilitating the removal fo cut material away from said center axis of said housing.

2. The cutter of claim 1 wherein said rotation registration device comprises a pair of diametrically opposed keyways extending inwardly from said rear face, said pair of keyways adapted to receive a pair of keys for rotatably securing said housing to the spindle.

3. The cutter of claim 1 wherein said metal wire bristles are formed of stainless steel.

4. The cutter of claim 1 wherein each of said brush assemblies further comprises a stem connected to and concentrically disposed relative to said sleeve.

5. The cutter of claim 4 wherein each said axial receiving bore includes an outer portion for receiving said sleeve and an inner portion in communication with said outer portion for receiving said stem.

6. The cutter of claim 5 wherein each said securing device comprises first and second set screws extending substantially radially within said annular wall, said first set screw engaging said sleeve and said second set screw engaging said stem.

7. The cutter of claim 1 further comprising an arbor lock screw including a head received within said counterbore and engaging said lock shoulder, thereby locking said housing to the spindle.

8. In a machine tool including a spindle rotatably supporting a shell mill arbor, said arbor including a cylindrical body portion supporting a pair of diametrically opposed keys and a cylindrical pilot positioned intermediate said keys, said pilot having a concentrically disposed threaded aperture, a cutter comprising:

a housing including an annular wall having a cylindrical outer surface and defining a longitudinal center axis, a front face connected to said outer surface, a rear face connected to said outer surface and positioned in spaced relation to said front face by said annular wall, a cylindrical inner surface defining an arbor bore extending substantially axially inwardly from said rear face towards said front face and coaxially aligned along said center axis, said arbor bore slidably receiving said pilot, a cylindrical intermediate surface defining a counterbore extending from said front face towards said rear face and coaxially aligned along said center axis, said colmterbore in communication with said arbor bore, a lock shoulder defined between said arbor bore and said counterbore, a plurality of circumferentially spaced axial receiving bores extending substantially axially inwardly from said front face towards said rear face, and a plurality of circumferentially spaced radial receiving bores extending substantially radially inwardly within said annular wall;

an arbor lock screw threadably received within said threaded aperture of said pilot, said lock screw including a head received within said counterbore and engaging said lock shoulder for securing said housing to said arbor shell;

a plurality of cutters slidably and removably received within a plurality of said receiving bores; and a plurality of cutting passageways, each of said passageways positioned intermediate a pair of said brush assemblies for facilitating the removal of cut material away from said center axis of said housing.

9. The machine tool of claim 8 further comprising a pair of diametrically opposes keyways extending inwardly from said rear face, and said pair of keyways receiving said pair of keys for rotably securing housing to said spindle.

10. The machine tool of claim 8 wherein said wire bristles are formed of stainless steel.

11. The machine tool of claim 8 wherein each of said brush assemblies further comprises a sleeve and a stem connected to and concentrically disposed relative to said sleeve.

12. The machine tool of claim 11 wherein each said axial receiving bore includes an outer portion for receiving said sleeve and an inner portion in communication with said outer portion for receiving said stem.

13. The machine tool of claim 12 further comprising first and second set screws extending substantially radially within said annular wall, said first set screw engaging said sleeve and said second set screw engaging said stem.

14. A cutter for being driven in rotation by a spindle, said cutter including:

a housing including an annular wall having a cylindrical outer surface and defining a longitudinal center axis, a front face connected to said outer surface, a rear face connected to said outer wall and positioned in spaced relation to said front face by said annular wall, a plurality of circumferentially spaced axial receiving bores extending substantially axially inwardly from said front face towards said rear face, and a plurality of circumferentially spaced radial receiving bores extending substantially radially inwardly within said annular wall;

a plurality of brush assemblies slidably and removably received within said plurality of axial and radial receiving bores, each of said brush assemblies including a sleeve and a plurality of metal wire bristles fixed within said sleeve;

a securing device operably connected to each of said brush assemblies for releasably securing said brush assemblies within said housing; and a plurality of cutting passageways, each of said passageways positioned intermediate a pair of said brush assemblies for facilitating the removal of cut material away from said housing.

15. The cutter of claim 14 wherein said housing further comprises:

a cylindrical inner surface defining an arbor bore extending axially inwardly from said rear face towards said front face and coaxially aligned along said center axis;

a cylindrical intermediate surface defining a counterbore extending from said front face towards said rear face and coaxially aligned along said center axis, said counterbore in communication with said arbor bore; and a lock shoulder defined between said arbor bore and said counterbore.

16. The cutter of claim 15 further comprising a lock screw for engaging said lock shoulder and thereby locking said housing to the spindle.

17. The cutter of claim 14 further comprising a pair of diametrically opposed keyways extending inwardly from said rear face, said pair of keyways adapted to receive a pair of keys for rotatably securing said housing to the spindle.

18. The cutter of claim 14 wherein said metal wire bristles are formed of stainless steel.

19. The cutter of claim 14 wherein each of said brush assemblies further comprises a stem connected to and concentrically disposed relative to said sleeve.

20. The cutter of claim 19 wherein each said axial and radial receiving bore includes an outer portion for receiving said sleeve and an inner portion in communication with said outer portion for receiving said stem.

* * * * *

UNITED STATES PATENT AND TRADEMARK OFFICE

CERTIFICATE OF CORRECTION

PATENT NO. : 6,309,291 B1
DATED : October 30, 2001
INVENTOR(S) : Bill Robertson Cox It is certified that error appears in the above-identified patent and that said Letters Patent is hereby corrected as shown below:

Column 6, claim 1,
Line 35, "fo" should be -- of --.

Column 7, claim 9,
Line 31, after diametrically "opposes" should be -- opposed --.

Signed and Sealed this

Twelfth Day of March, 2002

*Attest:*

*Attesting Officer*

JAMES E. ROGAN
*Director of the United States Patent and Trademark Office*